US010914156B2

(12) United States Patent
Coats et al.

(10) Patent No.: US 10,914,156 B2
(45) Date of Patent: Feb. 9, 2021

(54) FRAC PULSER SYSTEM AND METHOD OF USE THEREOF

(71) Applicant: Halliburton Energy Services, Inc., Houston, TX (US)

(72) Inventors: Alan Coats, Houston, TX (US); Stanley V. Stephenson, Duncan, OK (US); Tim H. Hunter, Duncan, OK (US); Jim Basuki Surjaatmadja, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/426,694

(22) Filed: May 30, 2019

(65) Prior Publication Data

US 2020/0378231 A1 Dec. 3, 2020

(51) Int. Cl.

| | |
|---|---|
| ***E21B 43/267*** | (2006.01) |
| ***E21B 43/114*** | (2006.01) |
| ***E21B 43/26*** | (2006.01) |
| ***E21B 43/119*** | (2006.01) |

(52) U.S. Cl.

CPC ..... *E21B 43/267* (2013.01); *E21B 43/114* (2013.01); *E21B 43/119* (2013.01); *E21B 43/261* (2013.01)

(58) Field of Classification Search

CPC .... E21B 43/112; E21B 43/114; E21B 43/119; E21B 43/26; E21B 43/263; E21B 43/267; E21B 43/261

See application file for complete search history.

(56) References Cited

U.S. PATENT DOCUMENTS

| | | | | |
|---|---|---|---|---|
| 4,530,396 | A | 7/1985 | Mohaupt | |
| 9,506,333 | B2 | 11/2016 | Castillo et al. | |
| 9,528,360 | B2 | 12/2016 | Castillo et al. | |
| 2003/0075328 | A1* | 4/2003 | Challacombe | E21B 43/263 166/299 |
| 2007/0151731 | A1 | 7/2007 | Butler et al. | |
| 2008/0149329 | A1* | 6/2008 | Cooper | E21B 43/267 166/250.01 |
| 2012/0067582 | A1 | 3/2012 | Fincher | |
| 2012/0186816 | A1* | 7/2012 | Dirksen | E21B 7/00 166/297 |
| 2012/0279713 | A1 | 11/2012 | Leon et al. | |
| 2015/0053397 | A1 | 2/2015 | Filyukov et al. | |
| 2015/0129230 | A1* | 5/2015 | Carlson | E21B 43/00 166/308.1 |
| 2015/0167438 | A1 | 6/2015 | Rey-Bethbeder et al. | |
| 2016/0040520 | A1 | 2/2016 | Tolman et al. | |
| 2016/0168962 | A1 | 6/2016 | Tolman et al. | |
| 2017/0159404 | A1 | 6/2017 | Sewell | |
| 2017/0204714 | A1 | 7/2017 | Roesner | |
| 2017/0234108 | A1 | 8/2017 | Xu | |

(Continued)

*Primary Examiner* — David Carroll

(74) *Attorney, Agent, or Firm* — John Wustenberg; Parker Justiss, P.C.

(57) ABSTRACT

Provided is a downhole fracturing tool assembly, and a method for fracturing an oil/gas formation. The downhole fracturing tool assembly, in one aspect, includes a tool body, and a localized fracking system located within the tool body. In accordance with this aspect, the localized fracking system is designed to create a localized initial pulse of pressure sufficient to initiate a fracture of a subterranean zone of interest.

25 Claims, 6 Drawing Sheets

(56) References Cited

U.S. PATENT DOCUMENTS

| | | | | |
|---|---|---|---|---|
| 2017/0335644 | A1 | 11/2017 | Ciezobka | |
| 2018/0171738 | A1 | 6/2018 | Xu et al. | |
| 2019/0162871 | A1* | 5/2019 | Dell | E21B 43/267 |

* cited by examiner

FRAC PULSER SYSTEM AND METHOD OF USE THEREOF

TECHNICAL FIELD

This application is directed, in general, to a downhole fracturing tool assembly, and more specifically, to an improved downhole fracturing tool assembly that creates localized pulse of pressure.

BACKGROUND

Many subterranean formations containing hydrocarbon reservoirs suffer from the problem of having insufficient permeability or productivity to enable the hydrocarbons to be recovered at the surface in an effective and economical manner. To increase the permeability or productivity of these formations, the formations are fracked/fractured and stimulated. While fracking is a well-known art, improvements are nevertheless needed in the tools and/or methods for fracturing subterranean formations.

BRIEF DESCRIPTION

Reference is now made to the following descriptions taken in conjunction with the accompanying drawings, in which.

DETAILED DESCRIPTION

Figure 1:
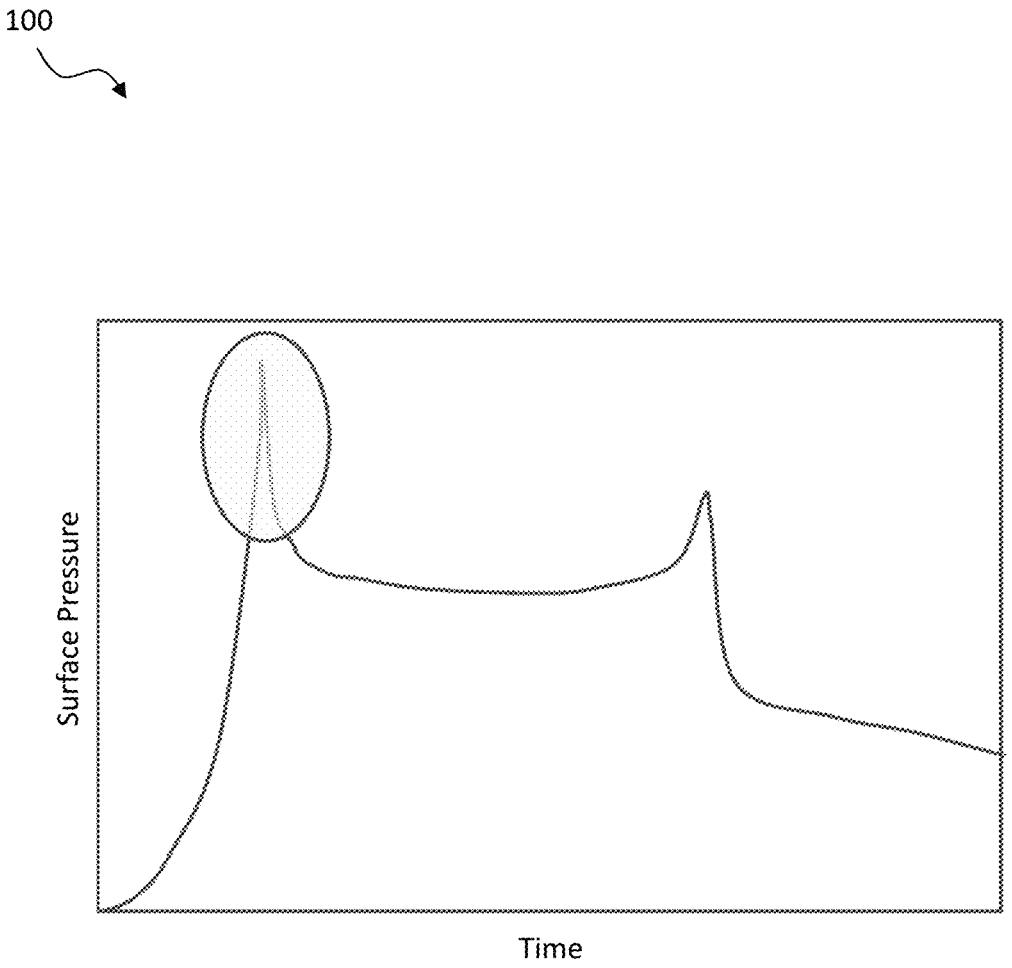
FIG. 1 illustrates an example graph illustrating the initial high pressure spike that may be necessary to open a fracture.

The present disclosure is based, at least in part, on the acknowledgment that in fracture stimulation, the initial pressure to open a fracture is much higher than is necessary to complete the stimulation process. Turning briefly to FIG. 1, illustrated is an example graph 100 illustrating this initial high pressure spike that may be necessary to open a fracture. Note that the initial pressure spike is significantly higher than the pressure required for the remainder of the stimulation process. Unfortunately, the equipment employed during the fracturing process must be able to withstand the initial spikes in pressure, even though the remainder of the stimulation process requires much lower pressures. For example, the pumps, surface iron, manifolds, wellhead portions, isolation tools, etc. must be able to handle these initial spikes in pressure. Furthermore, associated pressure control limiters must also be set above such initial spike pressure levels.

With the forgoing acknowledgment in mind, the present disclosure has further acknowledged that the pressure spike is generally necessary because of the near-wellbore stresses, e.g., because the initial fracture is at an angular direction from the local fracture direction. The larger the obliqueness of the position (e.g., near 90 degrees), the higher the spike. Once the fracture opens, the pressure requirement drops rapidly, as the fractures will take fluid and bend towards the max stress direction.

Given the foregoing acknowledgments, the present disclosure has recognized that a downhole rapid pressure modification system, for example that is significant enough to temporarily increase the initial downhole pressure to account for the near-wellbore stresses, may be used to initiate the fracture, without affecting the surface pressure requirements. In accordance with this recognition, introduced herein are a downhole fracturing tool assembly and a method of using the assembly that can create a sufficient local pressure (e.g., downhole near the zone of interest) to initiate a fracture therein. The introduced downhole fracturing tool assembly and method can, thus, locally create a pulse of pressure that is sufficient to initiate a fracture in the subterranean zone of interest using a localized fracking system. The localized fracking system can create a large initial pulse of pressure using an explosive, such as a current or spark initiated digital explosive, and/or an actuator, such as a piston or ball-release actuator, among other conceivable methods.

The introduced downhole fracturing tool assembly and method provides the following advantages over the conventional fracturing method. First, the introduced downhole fracturing tool assembly and method improves overall equipment life by reducing the pressures that are necessary for the fracturing process, and thus being subjected to the equipment. Second, the introduced downhole fracturing tool and method reduces the power requirement in the field by eliminating the need to drive the high pressure fluid from the surface. As such, the introduced downhole fracturing tool and method would be able to reduce the operation and maintenance cost, as well as any non-productive time for customers.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the ground; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. In some instances, a part near the end of the well can be horizontal or even slightly directed upwards. In such instances, the terms "up," "upper," "upward," "uphole," "upstream," or other like terms shall be used to represent the toward the surface end of a well. Unless otherwise specified, use of the term "subterranean formation" shall be construed as encompassing both areas below exposed earth and areas below earth covered by water such as ocean or fresh water.

Figure 2:
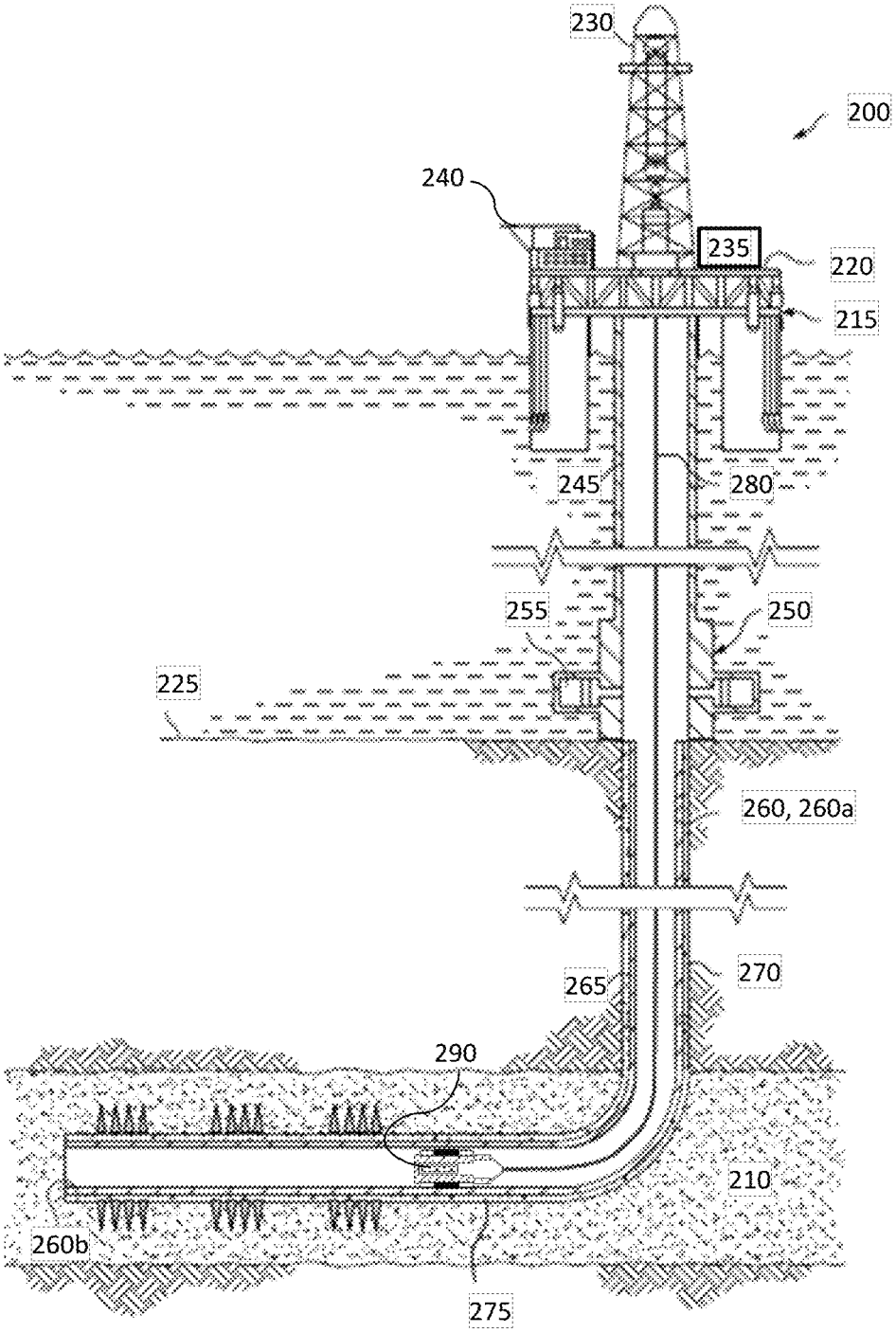
FIG. 2 illustrates a well system in which a wireline conveyed downhole fracturing tool assembly designed according to the principles of the disclosure is deployed.

Referring initially to FIG. 2, schematically illustrated is a well system 200, including a downhole fracturing tool assembly 290 manufactured and designed according to the present disclosure, and positioned at a desired location in a subterranean formation 210. The well system 200 of FIG. 2, without limitation, includes a semi-submersible platform 215 having a deck 220 positioned over the submerged oil and gas formation 210, which in this embodiment is located below sea floor 225. The well system 200 of FIG. 2 may be also located on a dry land. The platform 215, in the illustrated embodiment, may include a hoisting apparatus/derrick 230 for raising and lowering work string, as well as a fracturing pump 235 for conducting a fracturing process of the subterranean formation 210 according to the disclosure. The well system 200 illustrated in FIG. 2 additionally includes a control system 240 located on the deck 220. The control system 240, in one embodiment, may be communicatively, e.g., electrically, electromagnetically or fluidly, coupled to the downhole fracturing tool assembly 290, as well as may be used to control the fracturing pump 235, among other uses.

A subsea conduit 245 extends from the platform 215 to a wellhead installation 250, which may include one or more subsea blow-out preventers 255. A wellbore 260 extends through the various earth strata including formation 210. In the embodiment of FIG. 2, a casing 265 is cemented within wellbore 260 by cement 270. In the illustrated embodiment, wellbore 260 has an initial, generally vertical portion **260*a* and a lower, generally deviated portion 260*b*, which is illustrated as being horizontal. It should be noted by those skilled in the art, however, that the downhole fracturing tool assembly 290 of the present disclosure is equally well-suited for use in other well configurations including, but not limited to, inclined wells, wells with restrictions, non-deviated wells and the like. Moreover, while the wellbore 260 is positioned below the sea floor 225 in the illustrated embodiment of FIG. 2**, those skilled in the art understand that the principles of the present disclosure are equally as applicable to other subterranean formations, including those encompassing both areas below exposed earth and areas below earth covered by water such as ocean or fresh water.

When it is desired to fracture a particular subterranean zone of interest, such as zone 275, the downhole fracturing tool assembly 290 may be deployed within the wellbore 260 using a downhole conveyance 280. In the illustrated embodiment of FIG. 2, the downhole conveyance 280 is a wireline, and furthermore the wireline is coupled to the control system 235. The term wireline, as used herein, is intended to include all downhole electrical conveyance devices, including without limitation wireline, slickline, braided line, etc. In one particular embodiment of the disclosure, all communication with the downhole fracturing tool assembly 290 is via a wireline, as opposed to a drill string, a coiled tubing, etc.

With the downhole fracturing tool assembly 290 in place, pressure within the wellbore 260 may be increased using the fracturing pump 235 and one or more different types of fracturing fluid and/or proppants. Once a threshold pressure is achieved, the downhole fracturing tool assembly 290 may be operated to introduce a localized initial pulse of pressure sufficient to initiate a fracture of the subterranean zone of interest 275. In one example embodiment, the downhole fracturing tool assembly 290 generates the localized initial pulse of pressure to initiate the fracture, and the pressure created by the fracturing pump 235 extends the fracture. In another alternative embodiment, the downhole fracturing tool assembly 290 generates the localized initial pulse of pressure to initiate the fracture, and then generates one or more subsequent pulses of pressure sufficient to extend (e.g., along with the threshold pressure generated with the fracturing pump 235) the fracture of the subterranean zone of interest 275.

In certain embodiments, discussed more fully below, the downhole fracturing tool assembly 290 includes an isolation assembly (e.g., including one or more slips and/or one or more packers) that radially deploy therefrom. In this embodiment, the downhole fracturing tool assembly 290 may be used to isolate a portion of the wellbore 260 below the subterranean zone of interest 275, for example prior to generating the localized initial pulse of pressure. In certain other embodiments, again discussed more fully below, the downhole fracturing tool assembly 290 additionally includes a perforator coupled thereto. The perforator, which in one embodiment may be a perforating gun assembly or hydrajet perforating assembly, among others, may be used to perforate the casing 265 after the isolation assembly has been set and prior to generating the localized initial pulse of pressure. In this embodiment, the subterranean zone of interest 275 is isolated, perforated, and fractured using a single (e.g., wireline deployed) downhole assembly, and moreover may be done so without the aforementioned significant surface pressure spikes.

Figure 3:
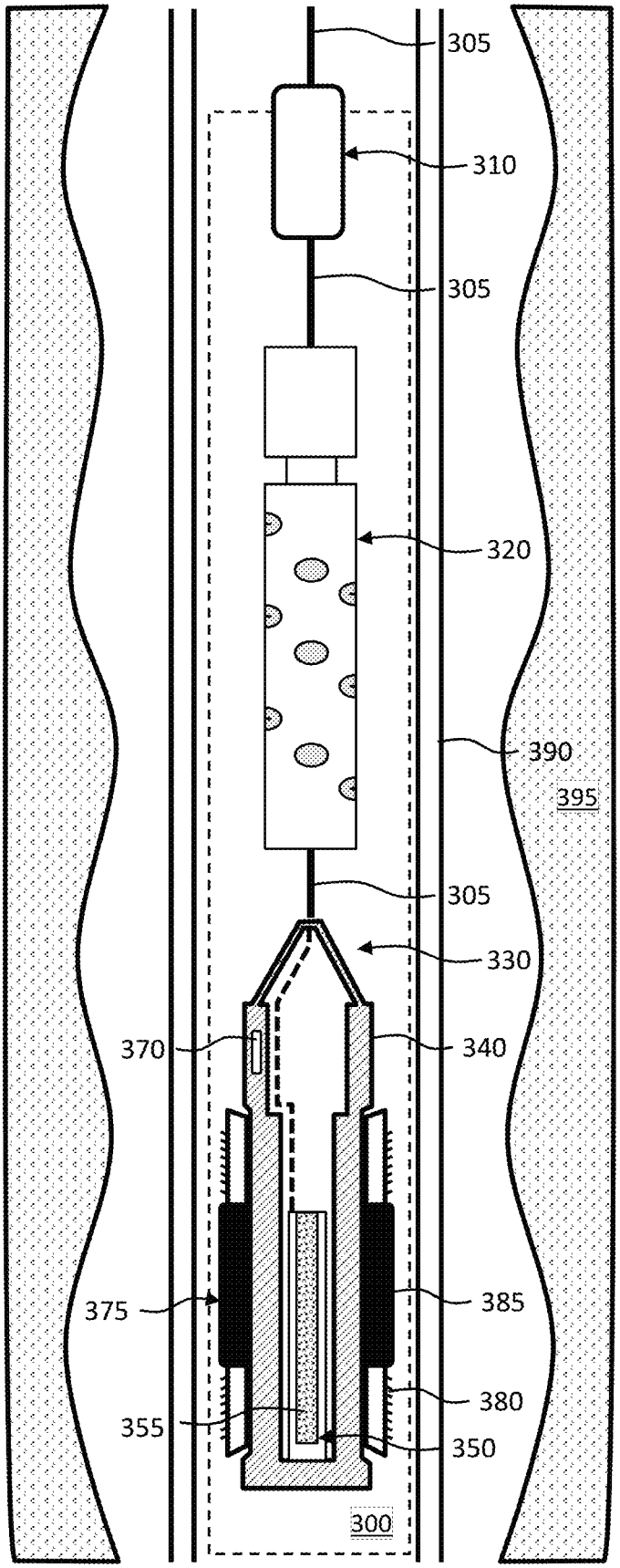
FIG. 3 illustrates an embodiment of a downhole fracturing tool assembly designed according to the principles of the disclosure.

Turning to FIG. 3, illustrated is one embodiment of a downhole fracturing tool assembly 300 designed and manufactured according to one embodiment of the disclosure. The downhole fracturing tool assembly 300, in the illustrated embodiment, is positioned within a wellbore casing 390 positioned in a wellbore 395. In the illustrated embodiment shown, the downhole fracturing tool assembly 300 is deployed at a subterranean zone of interest (e.g. similar to the subterranean zone of interest 275 of FIG. 2).

The downhole fracturing tool assembly 300, in the illustrated embodiment of FIG. 3, includes a connector 310, a perforator 320, and a downhole fracturing tool 330, among other possible devices and/or features. In the illustrated embodiment, the connector 310, the perforator 320 and the downhole fracturing tool 330 are connected serially using a conveyance device 305, such as a wireline. In accordance with this embodiment, the conveyance device 305 may provide one or more signals (e.g., electrical signals) to the perforator 320 and/or downhole fracturing tool 330. In one embodiment, the conveyance device 305 may be a coiled tubing or tubing, and if electrical signals are needed, a wireline could be carried inside the coiled tubing. In another embodiment, the conveyance device 305 may be a jointed pipe, and to carry electrical signals, a wireline may be attached on the outside of the jointed pipe. In yet another embodiment, the fracturing tool assembly 300 may be conveyed by a tractor to its final destination.

The connector 310, in the illustrated embodiment, is designed to connect/disconnect any one of the perforator 320 and/or the downhole fracturing tool 330 from the conveyance device 305 when any of said components needs to be repaired, replaced or abandoned. The connector 310 may use any currently known or hereafter discovered connecting/disconnecting mechanism and remain within the purview of the disclosure. Accordingly, the present disclosure should not be limited to any specific connector 310.

The perforator 320, in the illustrated embodiment, is a perforating tool designed to perforate a portion of the casing 390, as well as any cement that may be located between the casing 390 and the wellbore 395. As those skilled in the art appreciate, the perforations allow the fracturing fluid to reach the subterranean zone of interest during subsequent fracturing processes, as well as allow production fluids to enter the casing 390 during well production. The perforator 320, in one embodiment, may be positioned proximate the downhole fracturing tool 330, e.g., between the connector 310 and the downhole fracturing tool 330.

In one example embodiment, the perforator 320 is a perforating gun assembly configured to discharge one or more charges (e.g., shaped charges in one embodiment) to form the perforations in the casing 390. In embodiments wherein a perforating gun assembly is used, signals (e.g., electrical signals) may travel down the conveyance device 305 for operation thereof. In another example embodiment, the perforator 320 is a hydrajet perforating assembly configured to employ high pressure jets of fluid (e.g., as opposed to charges) to form the perforations in the casing 390. One such hydrajet perforating assembly may be purchased from Halliburton Energy Services (Houston, Tex.) under the tradename Hydra-Jet™. In embodiments where a hydrajet perforating assembly is used, the perforator 320 might be coupled to surface equipment using a tubular (e.g., coiled tubing in one example).

It is understood that the connector 310 and perforator 320 may be omitted from the downhole fracturing tool assembly 300 depending on the application in which the downhole fracturing tool assembly 300 is used. For example, to frack an open-hole portion of the wellbore 395, the perforator 320 may be omitted, and thus there may be no need for the connector 310.

The downhole fracturing tool 330, in accordance with the disclosure, is configured to create a localized initial pulse of pressure sufficient to initiate a fracture of the subterranean zone of interest. The term "localized pulse," unless specifically stated otherwise, hereinafter refers to a pulse that is localized or contained proximate to a zone to which a fracturing operation is directed, but does not extend uphole to negatively affect the surface equipment. For example, while the zone of interest might see a large spike such as that shown in FIG. 1 above, the surface equipment would see no such spike—or at most, a very small spike.

The downhole fracturing tool 330, in the illustrated embodiment, includes a tool body 340. The tool body 340 may comprise a variety of different configurations and/or materials and remain with the scope of the disclosure. In the embodiment shown, the tool body 340 is a metal tubular. Located within the tool body 340, in the embodiment of FIG. 3, is a localized fracking system 350. The localized fracking system 350, in accordance with the disclosure, is configured to create the aforementioned localized initial pulse of pressure to initiate a fracture of the subterranean zone of interest. For example, this localized initial pulse of pressure may be created while the wellbore 395 is already being subjected to a typical fracturing process.

In the illustrated embodiment, the localized fracking system 350 includes an explosive device 355. The explosive device 355, in the illustrated embodiment, is the feature of the localized fracking system 350 that is designed to provide the localized initial pulse of pressure. A variety of different explosive devices and/or materials are within the scope of the present disclosure. In one embodiment, the explosive device 355 includes a single charge configured to provide a single initial pulse of pressure. Those skilled in the art, given the aforementioned disclosure, would be able to design and manufacture such a single shot explosive device 355.

In other embodiments, the explosive device 355 is designed to provide multiple different explosions, which allows the localized fracking system 350 to provide multiple pulses of pressure (e.g., whether initial pulses or subsequent pulses) to the subterranean zone of interest. And in even different embodiments, the explosive device 355 is designed to provide varying amounts of localized pressure, for example depending on how the explosive device 355 is detonated. One such explosive device 355 that provides multiple detonations and varying degrees of pulses in pressure is a current initiated solid state propulsion device. When using such a current detonated device, the number of explosions and/or size of the explosions, and thus the number and size of the pressure pulse(s), may be modulated by varying the duration of the current or amount of the current, respectively. By creating modulated current, the current initiated solid state propulsion device can create a desired series of pressure pulses, which can help initiating the fracture. Another such explosive device 355 that provides multiple detonations and varying degrees of pulses in pressure is a spark initiated solid state propulsion device. When using such a spark detonated device, the number of explosions and/or size of the explosions, and thus the number and size of the pressure pulse(s), may be modulated by varying the duration of the spark or size of the spark, respectively. By creating modulated sparks, the spark detonated device can create a desired series of pressure pulses that can help initiating the fracture. Current initiated solid state propulsion devices and spark initiated solid state propulsion devices, as might be used herein, may be purchased from Digital Solid State Propulsion, Inc., having a principal place of business of 5474 Louie Lane, Reno, Nev. 89511. Those skilled in the art understand the various different mechanisms that may be used to control the explosive device 355, including an electrical signal provided through the conveyance device 305 from uphole (e.g., from the control system 240 of FIG. 2) or provided from a local control system in the downhole fracturing tool 330.

The localized fracking system 350, for example by way of the current initiated solid state propulsion devices and spark initiated solid state propulsion devices, among others, may be configured to create one or more localized subsequent pulses of pressure sufficient to extend the fracture of the subterranean zone of interest in certain embodiments. The subsequent pulses of pressure, in one or more embodiments, may be less than the initial pulse of pressure, but yet sufficient to stimulate the fracture in the zone.

In the illustrated embodiment, the localized fracking system 350 is designed to create the localized subsequent pulse of pressure at varying frequencies that correspond with the natural frequencies of the fracture. By varying the timing of the detonation, the localized subsequent pulse of pressure can be varied to correspond with the natural frequencies of the fracture as the fracture extends into the zone of interest. For example, the downhole fracturing tool 330 could employ a sensor 370 to measure the pressure of the zone of interest throughout the fracturing operation. Based on the changes in the pressure, the pressure sensor 370 can detect the natural frequencies of the fracture as the fracture extends into the zone of interest. Thus, the natural frequencies of the fracture may be relayed to a control system, e.g., a local control system within the downhole fracturing tool 330 or the surface control system 240 in FIG. 2, for controlling the localized fracking system 350. In the illustrated embodiment, the pressure sensor 370 is a fiber-optic pressure sensor located on the tool body 340. It should be noted however, that other types of sensors having a variety of different locations may be used to detect the natural frequencies of the fracture.

The downhole fracturing tool 330, in the illustrated embodiment, additionally includes an isolation assembly 375 radially deployable from the tool body 340. The isolation assembly 375, in the illustrated embodiment, is an electrically actuated isolation assembly 375 that includes one or more slips 380 and/or packers 385. For example, the conveyance device 305 could be used to send a signal to the electrically actuated isolation assembly 375 to radially deploy. While the isolation assembly 375 is illustrated in FIG. 3 in the radially retracted state, those skilled in the art understand that if deployed the slips 380 and packer 385 would be engaged with the casing 390, and thus provide the isolation necessary for the fracturing process.

Figure 4:
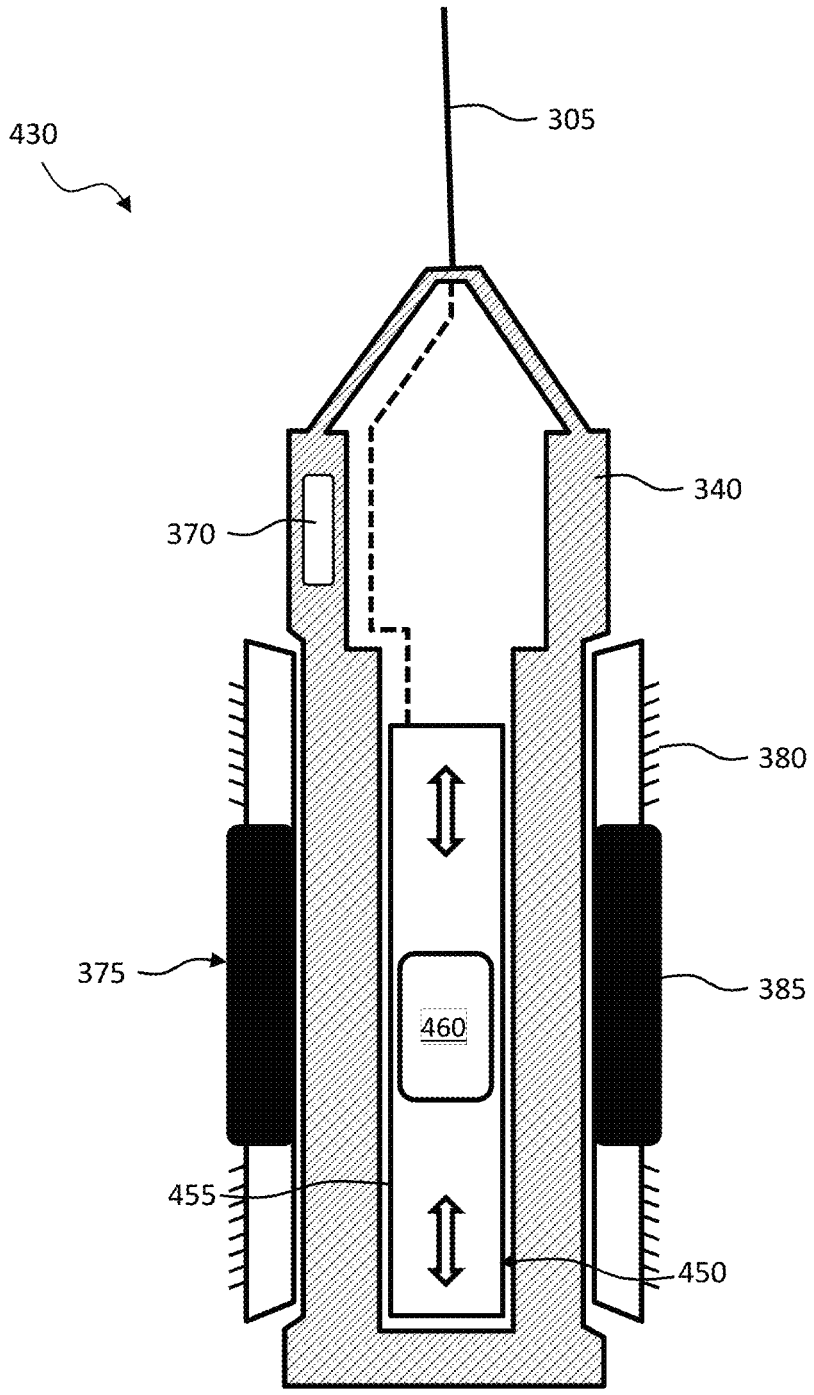
FIG. 4 illustrates an alternative embodiment of a downhole fracturing tool designed according to the principles of the disclosure.

Turning to FIG. 4, illustrated is another embodiment of a downhole fracturing tool 430 designed and manufactured according to an alternative embodiment of the disclosure. The downhole fracturing tool 430 shares many similar features as the downhole fracturing tool 330. Accordingly, like reference numbers may be used to reference similar (e.g., if not identical) features. The downhole fracturing tool 430 differs from the downhole fracturing tool 330, primarily in that the downhole fracturing tool 430 employs a different localized fracking system 450. The localized fracking system 450, in comparison to the localized fracking system 350, employs a linear oscillatory actuator device that is designed to create the localized pulses of pressure. In the illustrated embodiment, the linear oscillatory actuator device includes an electrical coil 455, and a piston 460 surrounded by the electrical coil 455. The linear oscillatory actuator device is designed to oscillate the piston 460 linearly to create the localized pulses of pressure. The linear oscillatory actuator device may be controlled electrically by the control system, such as the surface control system 240 in FIG. 2 or a local control system within the downhole fracturing tool 330 in FIG. 3, to oscillate the piston 460 at a desired frequency. For example, the linear oscillatory actuator device can oscillate the piston 460 at varying frequencies that correspond with the natural frequencies of the fracture, as discussed above.

Figure 5:
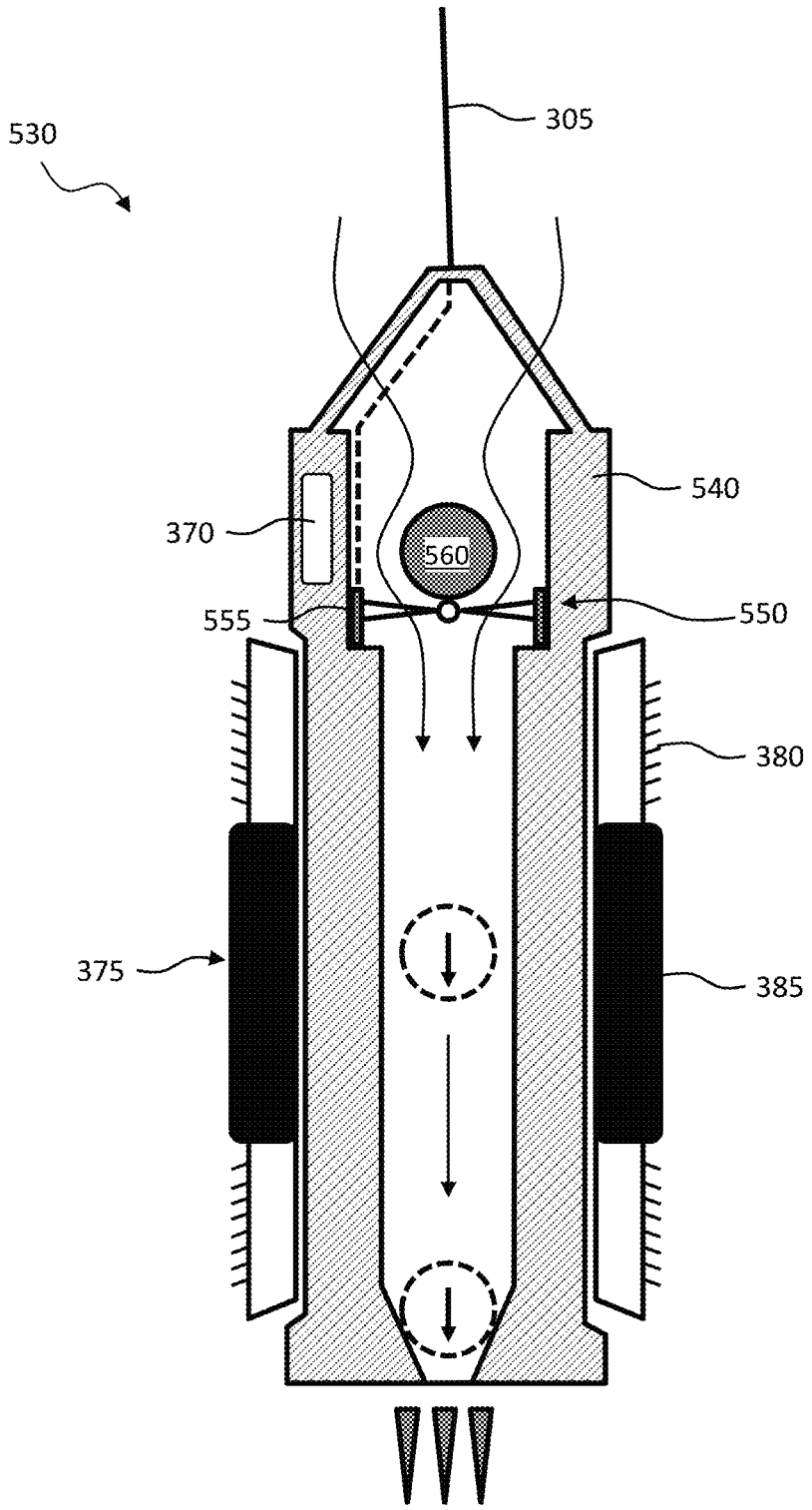
FIG. 5 illustrates yet another alternative embodiment of a downhole fracturing tool designed according to the principles of the disclosure.

Turning to FIG. 5, illustrated is another embodiment of a downhole fracturing tool 530 designed and manufactured according to yet another alternative embodiment of the disclosure. The downhole fracturing tool 530 shares many similar features as the downhole fracturing tools 330, 430. Accordingly, like reference numbers may be used to reference similar (e.g., if not identical) features. The downhole fracturing tool 530 differs from the downhole fracturing tools 330, 430, primarily in that the downhole fracturing tool 530 employs a different tool body 540, as well as a different localized fracking system 550. The tool body 540, in the illustrated embodiment of FIG. 5, is a flow-through container system designed to house the localized fracking system 550. In the illustrated embodiment, the tool body 540 allows the fracturing fluid, in certain instances, to pass there through.

In the illustrated embodiment, the localized fracking system 550 employs a ball-release fluid hammer actuator device designed to create the localized initial pulse of pressure. The localized tracking system 550, in the illustrated embodiment, includes a ball release 555 that holds a ball 560 at an initial position. The ball release 555 is designed to release the ball 560 from the initial position to create the localized pulse of pressure. The ball release 555 may be controlled electrically by the control system, such as the surface control system 240 in FIG. 2 or a local control system within the downhole fracturing tool 330 in FIG. 3, or by fracturing fluid. When controlled by the fracturing fluid, the ball release 555 allows lower flow rates of the fracturing fluid to flow through the tool body 540, but triggers to release the ball 560 when it encounters higher flow rates. When the ball release is triggered, it drops the ball 560, sealing the bottom and creating a water hammer effect. The water hammer effect, in accordance with the disclosure, provides the localized initial pulse of pressure sufficient to initiate a fracture of a subterranean zone of interest. It should be understood that the ball-release fluid hammer actuator device illustrated in FIG. 5 can be reset after the initial use by reducing the surface pressure and allowing reverse-flow from the lower zones. The water hammer effect hence can be created multiple times during the deployment.

Figure 6:
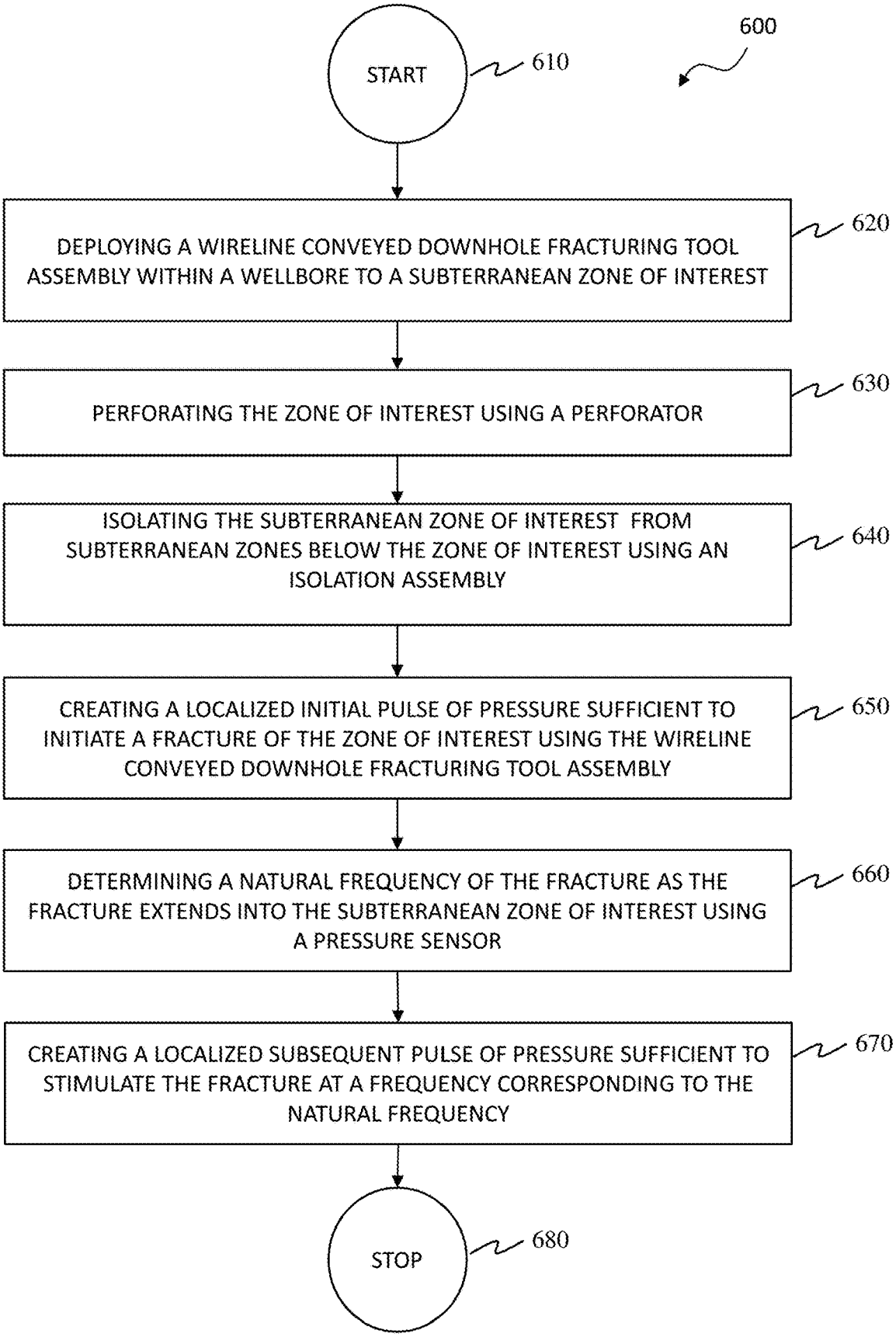
FIG. 6 illustrates an embodiment of a method for fracturing an oil/gas formation according to the principles of the disclosure.

Turning to FIG. 6, illustrated is one embodiment of a method 600 for fracturing an oil/gas formation according to the disclosure. The method 600 may be performed using a downhole fracturing tool assembly, such as the downhole fracturing tool assembly 300 in FIG. 3, among other downhole fracturing tool assemblies manufactured and designed according to the disclosure. The method begins in a start step 610.

At step 620, a downhole fracturing tool assembly is deployed within a wellbore to a subterranean zone of interest. The zone of interest refers to a targeted region in the oil/gas formation that is to be perforated and fractured for production. In step 620, the downhole fracturing tool assembly may be deployed within the wellbore using a conveyance device, such as a wireline.

At step 630, the zone of interest is perforated using a perforator. The perforator may be a perforating gun that is design to shoot a charge into the inner wall of a casing, through the cement outside the outer wall of the casing, and out into the zone of interest. In another embodiment, the perforator may also be a hydrajet perforating assembly, or a different perforator.

At step 640, the zone of interest is isolated from a portion of the wellbore that sits below the zone of interest using an isolation assembly. The isolation assembly, in one embodiment, is radially deployed from a tool body of the downhole fracturing tool assembly and seals the portion of the wellbore sitting below the isolation assembly. It is understood that if the zone of interest is the bottom end of the wellbore, the isolation assembly need not be deployed, and step 640 may be omitted. It should be further understood that step 640 may occur before step 630 in certain embodiments.

At step 650, a localized initial pulse of pressure is created using the downhole fracturing tool assembly. More specifically, the localized initial pulse of pressure is created using a localized fracking system, which forms, with a tool body, a portion of a downhole fracturing tool. The localized initial pulse of pressure is sufficient to initiate a fracture of the zone of interest. The localized initial pulse of pressure can be created using an explosive device, a linear oscillatory actuator device, a ball-release fluid hammer actuator device, or another device manufactured and designed according to the disclosure.

At step 660, natural frequencies of the fracture that extend into the zone of interest are detected using a sensor (e.g., pressure sensor). The sensor may be located on/in the tool body, and can detect the natural frequencies of the fracture based on the changes in the pressure measurements as the fracture develops after the initial fracture. While the sensor has been described as being located on/in the tool body, those skilled in the art understand that other locations for the sensor are within the scope of the disclosure, so long as the sensor is capable of taking the necessary pressure measurements to detect the natural frequency of the fracture.

At step 670, a localized subsequence pulse of pressure is created using the downhole fracturing tool assembly. More specifically, the localized subsequent pulse of pressure is created using the localized fracking system of a downhole fracturing tool. The localized subsequent pulse of pressure is sufficient to stimulate the fracture, and may be created at varying frequencies that correspond with the natural frequencies of the fracture. Similar to step 650, the localized subsequent pulse of pressure can be created by using an explosive device, a linear oscillatory actuator device, a ball-release fluid hammer actuator device, or another device manufactured and designed according to the disclosure. The magnitude of the pressure created can be controlled by controlling the amount of the explosive being detonated, and the frequency of the pressure can be controlled by timing the activations of the localized fracking system.

The method 600 ends in a stop step 680.

Aspects disclosed herein include:

A. A downhole fracturing tool assembly, comprising: a tool body; and a localized fracking system located within the tool body, the localized fracking system designed to create a localized initial pulse of pressure sufficient to initiate a fracture of a subterranean zone of interest.

B. A method for fracturing an oil/gas formation, comprising: deploying a downhole fracturing tool assembly within a wellbore to a subterranean zone of interest, the downhole fracturing tool assembly including: a tool body; and a localized fracking system located within the tool body; and creating a localized initial pulse of pressure sufficient to initiate a fracture of the subterranean zone of interest using the downhole fracturing tool assembly.

Aspects A, B, and C may have one or more of the following additional elements in combination. Element 1: further including an isolation assembly radially deployable from the tool body. Element 2: wherein the tool body and the localized fracking system form at least a portion of a downhole fracturing tool, and wherein the wireline conveyed downhole fracturing tool assembly further includes a perforator coupled to the tool body. Element 3: wherein the downhole fracturing tool assembly is deployed to the subterranean zone of interest via a wireline, and the perforator is a perforating gun assembly. Element 4: wherein the downhole fracturing tool assembly is deployed to the subterranean zone of interest via tubing the perforator is a hydrajet perforating assembly. Element 5: wherein the localized fracture initiation system is an explosive device designed to create the localized initial pulse of pressure. Element 6: wherein the explosive device is a current initiated solid state propulsion device. Element 7: wherein the explosive device is a spark initiated solid state propulsion device. Element 8: wherein the localized fracking system is a linear oscillatory actuator device designed to create the localized initial pulse of pressure. Element 9: wherein the localized fracking system is a ball-release fluid hammer actuator device designed to create the localized initial pulse of pressure. Element 10: wherein the localized fracking system is further designed to create one or more localized subsequent pulses of pressure sufficient to extend the fracture of the subterranean zone of interest. Element 11: wherein the one or more localized subsequence pulses of pressure are created at varying frequencies that correspond with natural frequencies of the fracture as the fracture extends into the subterranean zone of interest. Element 12: further including a pressure sensor positioned proximate the tool body. Element 13: wherein the pressure sensor is a fiber-optic pressure sensor. Element 14: wherein the pressure sensor is designed to detect the natural frequencies of the fracture as the fracture extends into the subterranean zone of interest. Element 15: wherein the downhole fracturing tool assembly further includes an isolation assembly radially deployable from the tool body, and further including isolating a portion of the wellbore below the subterranean zone of interest using the isolation assembly. Element 16: wherein the tool body and the localized fracking system form at least a portion of a downhole fracturing tool, and wherein the downhole fracturing tool assembly further includes a perforator coupled to the tool body, and further including perforating the subterranean zone of interest using the perforator prior to creating the localized initial pulse of pressure. Element 17: wherein deploying a downhole fracturing tool assembly includes deploying the downhole fracturing tool assembly via a wireline, and the perforator is a perforating gun assembly. Element 18: wherein deploying a downhole fracturing tool assembly includes deploying the downhole fracturing tool assembly via tubing, and the perforator is a hydrajet perforating assembly. Element 19: wherein the localized fracking system is an explosive device, and wherein creating a localized initial pulse of pressure sufficient to initiate a fracture of the subterranean zone of interest using the downhole fracturing tool assembly includes creating the localized initial pulse of pressure using the explosive device: Element 20: wherein creating the localized initial pulse of pressure using the explosive device includes creating the localized initial pulse of pressure using a current initiated solid state propulsion device or a spark initiated solid state propulsion device. Element 21: wherein the localized fracking system is a linear oscillatory actuator device, and further wherein creating a localized initial pulse of pressure sufficient to initiate a fracture of the subterranean zone of interest using the downhole fracturing tool assembly includes creating the localized initial pulse of pressure using the linear oscillatory actuator device. Element 22: wherein the localized fracking system is a ball-release fluid hammer actuator device, and further wherein creating a localized initial pulse of pressure sufficient to initiate a fracture of the subterranean zone of interest using the downhole fracturing tool assembly includes creating the localized initial pulse of pressure using the ball-release fluid hammer actuator device. Element 23: further including creating one or more localized subsequent pulses of pressure sufficient to extend the fracture of the subterranean zone of interest using the downhole fracturing tool assembly. Element 24: wherein the downhole fracturing tool assembly further includes a pressure sensor positioned proximate the tool body, and further including detecting the natural frequencies of the fracture as the fracture extends into the subterranean zone of interest using the pressure sensor.

Those skilled in the art to which this application relates will appreciate that other and further additions, deletions, substitutions and modifications may be made to the described embodiments.

What is claimed is:

1. A downhole fracturing tool assembly, comprising:

a downhole fracturing tool including:

a tool body; and a localized fracturing system located within the tool body, the localized fracturing system including a current initiated solid state propulsion device and configured to create a localized initial pulse of pressure sufficient to initiate a fracture of a subterranean zone of interest, wherein the localized fracturing system is further configured to create one or more localized subsequent pulses of pressure sufficient to extend the fracture of the subterranean zone of interest by varying an amount and a duration of a current provided to the current initiated solid state propulsion device.

2. The downhole fracturing tool assembly of claim 1, further including an isolation assembly radially deployable from the tool body.

3. The downhole fracturing tool assembly of claim 1, further including a perforator coupled to the tool body.

4. The downhole fracturing tool assembly of claim 3, wherein the downhole fracturing tool assembly is deployed to the subterranean zone of interest via a wireline, and the perforator is a perforating gun assembly.

5. The downhole fracturing tool assembly of claim 3, wherein the downhole fracturing tool assembly is deployed to the subterranean zone of interest via tubing, and the perforator is a hydrajet perforating assembly.

6. The downhole fracturing tool assembly of claim 1, wherein the one or more localized subsequence pulses of pressure are created at varying frequencies that correspond with natural frequencies of the fracture as the fracture extends into the subterranean zone of interest.

7. The downhole fracturing tool assembly of claim 6, further including a pressure sensor positioned proximate the tool body.

8. The downhole fracturing tool assembly of claim 7, wherein the pressure sensor is a fiber-optic pressure sensor.

9. The downhole fracturing tool assembly of claim 7, wherein the pressure sensor is configured to detect the natural frequencies of the fracture as the fracture extends into the subterranean zone of interest.

10. A method for fracturing an oil/gas formation, comprising:

deploying a downhole fracturing tool assembly within a wellbore to a subterranean zone of interest, the downhole fracturing tool assembly including a downhole fracturing tool having a tool body and a localized fracturing system located within the tool body, wherein the localized fracturing system includes a current initiated solid state propulsion device;

creating a localized initial pulse of pressure sufficient to initiate a fracture of the subterranean zone of interest; and creating one or more localized subsequent pulses of pressure sufficient to extend the fracture of the subterranean zone of interest by varying an amount and a duration of a current provided to the current initiated solid state propulsion device.

11. The method of claim 10, wherein the downhole fracturing tool assembly further includes an isolation assembly radially deployable from the tool body, and further including isolating a portion of the wellbore below the subterranean zone of interest using the isolation assembly.

12. The method of claim 10, wherein the downhole fracturing tool assembly further includes a perforator coupled to the tool body, and further including perforating the subterranean zone of interest using the perforator prior to creating the localized initial pulse of pressure.

13. The method of claim 12, wherein the deploying the downhole fracturing tool assembly includes deploying the downhole fracturing tool assembly via a wireline, and the perforator is a perforating gun assembly.

14. The method of claim 10, wherein the deploying the downhole fracturing tool assembly includes deploying the downhole fracturing tool assembly via tubing, and the perforator is a hydrajet perforating assembly.

15. The method of claim 10, wherein the one or more localized subsequence pulses of pressure are created at varying frequencies that correspond with natural frequencies of the fracture as the fracture extends into the subterranean zone of interest.

16. The method of claim 15, wherein the downhole fracturing tool assembly further includes a pressure sensor positioned proximate the tool body, and further including detecting the natural frequencies of the fracture as the fracture extends into the subterranean zone of interest using the pressure sensor.

17. A downhole fracturing tool assembly, comprising:

a downhole fracturing tool including:

a tool body; and a localized fracturing system located within the tool body, wherein the localized fracturing system is a ball-release fluid hammer actuator device configured to create a localized initial pulse of pressure sufficient to initiate a fracture of a subterranean zone of interest.

18. The downhole fracturing tool assembly of claim 17, wherein the ball-release fluid hammer actuator device is further configured to create one or more localized subsequent pulses of pressure to extend the fracture of the subterranean zone of interest.

19. The downhole fracturing tool assembly of claim 18, wherein the one or more localized subsequent pulses of pressure are created at varying frequencies that correspond with natural frequencies of the fracture as the fracture extends into the subterranean zone of interest.

20. The downhole fracturing tool assembly of claim 18, further including a pressure sensor positioned proximate the tool body.

21. The downhole fracturing tool assembly of claim 20, wherein the pressure sensor is configured to detect the natural frequencies of the fracture as the fracture extends into the subterranean zone of interest.

22. A method for fracturing an oil/gas formation, comprising:

deploying a downhole fracturing tool assembly within a wellbore to a subterranean zone of interest, the downhole fracturing tool assembly including a tool body and a localized fracturing system located within the tool body, wherein the localized fracturing system is a ball-release fluid hammer actuator device; and creating a localized initial pulse of pressure sufficient to initiate a fracture of the subterranean zone of interest using the ball-release fluid hammer actuator device.

23. The method of claim 22 further comprising creating one or more localized subsequent pulses of pressure sufficient to extend the fracture of the subterranean zone of interest using the ball-release fluid hammer actuator device.

24. The method of claim 23, wherein the one or more localized subsequence pulses of pressure are created at varying frequencies that correspond with natural frequencies of the fracture as the fracture extends into the subterranean zone of interest.

25. The method of claim 24, wherein the downhole fracturing tool assembly further includes a pressure sensor positioned proximate the tool body, and further including detecting the natural frequencies of the fracture as the fracture extends into the subterranean zone of interest using the pressure sensor.

* * * * *